US006712043B2

(12) United States Patent
Sadfa

(10) Patent No.: US 6,712,043 B2
(45) Date of Patent: Mar. 30, 2004

(54) ACTUATING FLUID CONTROL SYSTEM

(75) Inventor: Sidi Ould Sadfa, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 6 days.

(21) Appl. No.: 10/119,253

(22) Filed: Apr. 9, 2002

(65) Prior Publication Data

US 2003/0188720 A1 Oct. 9, 2003

(51) Int. Cl.[7] ..... F02M 37/04
(52) U.S. Cl. ..... 123/447; 123/458
(58) Field of Search ..... 123/446, 447, 123/506, 457–8

(56) References Cited

U.S. PATENT DOCUMENTS 5,357,929 A 10/1994 McCandless
5,460,329 A 10/1995 Sturman
5,485,820 A * 1/1996 Iwaszkiewicz ..... 123/458
5,682,858 A 11/1997 Chen et al.
6,112,721 A * 9/2000 Kouketsu et al. ..... 123/447
6,298,831 B1 * 10/2001 Rembold et al. ..... 123/506

* cited by examiner

*Primary Examiner*—Thomas N. Moulis
(74) *Attorney, Agent, or Firm*—Dennis Kelly Sullivan; Susan L. Lukasik; Jeffrey P. Calfa

(57) ABSTRACT

A control system for controlling the flow of an actuating fluid to an accumulator, the accumulator serving the fuel injectors of an internal combustion engine, includes a controller being in communication with a plurality of engine related sensors. A variable output pump is in fluid communication with a source of actuating fluid and has at least two selectable output conditions, the pump being operably coupled to the controller, the controller acting to selectively port a portion of the actuating fluid to the accumulator in a first pump output condition and to vent the portion of the actuating fluid to a reservoir in a second pump output condition resulting in power saving. A fuel injection system and a method of control are also included.

43 Claims, 5 Drawing Sheets

ACTUATING FLUID CONTROL SYSTEM

FIELD OF THE INVENTION

This invention relates to control of actuating fluid for use in an intensified fuel injection system for internal combustion engines. More particularly, the present invention controls a variable output pump that provides pressurized actuating fluid to an accumulator.

BACKGROUND OF THE INVENTION

A prior art hydraulically actuated, intensified injection system (commonly a HEUI injection system) 10 is depicted in prior art FIG. 1 and consists of five major components:

Electronic Control Module (ECM) 20

Injector Drive Module (IDM) 30

High Pressure actuating fluid supply pump 40

Rail Pressure Control Valve (RPCV) 50

HEUI Injectors 60

Electronic Control Module (ECM) 20

The ECM 20 is a microprocessor which monitors various sensors 22 from the vehicle and engine as it controls the operation of the entire fuel system 10. Because the ECM 20 has many more operational inputs than a mechanical governor, it can determine optimum fuel rate and injection timing for almost any condition. Electronic controls such as this are absolutely essential in meeting standards of exhaust emissions and noise.

Injector Drive Module (IDM) 30

The IDM 30 is communicatively coupled to the ECM 20 and receives commands therefrom. The IDM 30 sends a precisely controlled current pulse to energize the solenoid of each injector. Such energization acts to port high pressure actuating fluid to the intensifier of the respective injector 60. The timing and duration of the IDM 30 pulse are controlled by the ECM 20. In essence, the IDM 30 acts like a relay.

High Pressure Actuating Fluid Supply Pump 40

The high pressure actuating fluid supply pump 40 is a single stage pump and is in the prior art typically a seven piston fixed displacement axial piston pump and is driven by the engine. The high pressure actuating fluid supply pump 40 draws in low pressure actuating fluid (most commonly engine oil, but other actuating fluids could be used as well) from the reservoir 46, elevates the pressure of the actuating fluid for pressurization of the accumulator or rail 42. The rail 42 is plumbed to each injector 60. During normal engine operation, pump output pressure of the high pressure actuating fluid supply pump 40 is controlled by the Rail Pressure Control Valve (RPCV) 50, which dumps excess flow back to the return circuit 44 to the reservoir 46. The reservoir 46 is at substantially ambient pressure and may be at the normal pressure of the lubricating oil circulating in the engine of about 50 psi. Pressures for specific engine conditions are determined by the ECM 20.

Rail Pressure Control Valve (RPCV) 50

The RPCV 50 is an electrically operated dump valve, which closely controls pump output pressure of the high pressure actuating fluid supply pump 40 by dumping excess flow to the return circuit 44 and to the reservoir 46. A variable signal current from the ECM 20 to the RPCV 50 determines pump output pressure. Pump pressure can be maintained anywhere between about 450 psi and 4000 psi during normal engine operation. When the actuating fluid is engine lubricating oil, pressure while cranking a cold engine (below 50 degrees F.) is slightly higher because cold oil is thicker and components in the respective injectors 60 move slower. The higher pressure helps the injector 60 to fire faster until the viscosity of the actuating fluid (oil) is reduced.

HEUI Injector 60

Injectors 60 of this type are known and are representatively described in U.S. Pat. Nos. 5,460,329 and 5,682,858, incorporated herein by reference. The injector 60 includes an intensifier piston and plunger, the actuating fluid acting on the intensifier to pressurize a volume of fuel acted upon by the plunger. The injector 60 uses the hydraulic energy of the pressurized actuating fluid (preferably, lubricating oil) to dramatically increase the pressure of the volume of fuel and thereby to cause injection. Actuating fluid is ported to the intensifier by a valve controlled by a solenoid. The pressure of the incoming actuating fluid from the rail 42 controls the speed of the intensifier piston and plunger movement, and therefore, the rate of injection. The amount of fuel injected is determined by the duration of the pulse from the IDM 30 and how long it keeps the solenoid of the respective injector 60 energized. The intensifier amplifies the pressure of the actuating fluid and elevates the pressure of the fuel acted upon by the plunger from near ambient to about 20,000 psi for each injection event. As long as the solenoid is energized and the valve is off its seat, high pressure actuating fluid continues to push down the intensifier and plunger to continuously pressurize fuel for injection until the intensifier reaches the bottom of its bore.

Fuel economy is becoming more and more important. More efficiency in fuel usage is needed. The fuel consumption of the engine varies with engine speed and load. The need for actuating fluid also varies with engine speed and load, a higher volume of actuating fluid being required to develop sufficient high pressure fuel in the injector 60 at higher engine speeds and load. The actuating fluid pump 40 is engine driven and develops the same output at a given engine speed without regard for the volume of actuating fluid needed by the injectors 60. The volume is selected to ensure that the rail 42 is always fully charged with high pressure actuating fluid at the highest demand for actuating fluid. As noted above, excess actuating fluid is vented by the RPCV 50 to the reservoir 46. This means some engine power is used unnecessarily at lower to intermediate engine loads to run the actuating fluid pump 40. As noted above, in the prior art engines, the actuating fluid pump 40 is a one stage actuating fluid pump delivering actuating fluid to the pressurized rail 42. Under certain engine operating conditions, typically relatively low engine load, the unneeded actuating fluid is dumped to ambient (reservoir 46), resulting in energy loss.

In the prior art fuel injection system 10, pressurized actuating fluid (engine lubricating oil) is used to control the injected fuel quantity by using pressure amplification in the injectors 60. As noted above, a pressure source pumps actuating fluid to a pressure rail 42 (accumulator) where pressure is regulated according to the engine load and speed requirement. The pressure regulation is done via the pressure-regulating valve 50 that dumps excess pressurized actuating fluid to ambient in order to maintain the desired pressure in the rail 42. Although it is desirable to minimize the damped flow for efficiency purposes, the required demand must be maintained in order to assure stability of desired rail pressure.

In order to achieve a more efficient system, the delivery of the pump 40 must be controlled depending on the engine requirement. A continuous supply of actuating fluid to the rail is needed in order to maintain the desired rail pressure at any engine condition. Further, the engine power used to drive the actuating fluid pump should more nearly reflect the actuating fluid needed in the rail for the present engine operating condition.

SUMMARY OF THE INVENTION

The actuating fluid control system of the present invention is capable of meeting the aforementioned needs. By matching the power consumption of the actuating fluid pump to the engine needs, the engine fuel consumption is reduced, especially at lower engine load conditions. Further, a continuous supply of actuating fluid is supplied to the rail.

The pressure dynamics quality in the pressure rail 42 is a key player in such systems. The impact of transient flow discontinuity in the rail 42 has to be minimized. Dumping flow from a single actuating fluid pump as done in the past created objectionable high pressure fluctuations which were a significant source of transient flow discontinuity in the rail 42. Hence, a continuous steady flow from a pump stage to the rail 42 as provided for in the present invention has a stabilizing effect in the rail 42. Further, a proportional flow control valve as used in the present invention allows a smooth controllable pressure transition when transitioning from venting actuating fluid to supplying make up actuating fluid to the rail.

The multi-stage pumping system of the present invention, comprising a variable output pump, preferably two de-coupled pumps, is able to select the required flow rate according to the engine load and speed via a specific control strategy. This results in reducing the power used for driving the pump over the total range of engine operating conditions, power to the pump equaling fluid pressure times flow rate.

Depending on the engine need, by controlling actuating fluid pump delivery, the power lost in friction in the actuating fluid pump is ultimately reduced. A variable output or multi-stage actuating fluid pump system able to switch from one delivery quantity to another, according to the engine need, reduces the power consumption and, correspondingly, the fuel consumption. The switching strategy of the present invention is implemented via a three-way, two-position flow control valve connected to a low pressure pump. The flow control valve operates on and off to dump actuating fluid to ambient (no power consumption mode) or pump the actuating fluid to the rail (power consumption mode). The flow control valve is driven by a proportional solenoid. An injection pressure-regulating (IPR) valve, or RPCV, is incorporated for rail pressure regulation. A high-pressure pump is pumping actuating fluid continuously to the rail during engine operation, while a low-pressure actuating fluid pump is operated on and off, as noted above. The continuous flow from high-pressure pump is used to drive the system at loads ranging from zero to 50% load and acts to minimize rail pressure fluctuations while the low pressure pump is dumped to ambient.

The variable output or multi-stage pump of the present invention increases the overall efficiency of the engine by reducing the fuel consumption by 3 to 5%. The risk of noise and vibration due to pressure instabilities resulting from flow discontinuity and pressure spikes in the rail is reduced since the high flow pump pumps actuating fluid continuously during engine operation to insure stability of the system. Furthermore, a simple flow control strategy of the present invention can be implemented without major changes in the existing fuel system.

The present invention is a control system for controlling the flow of an actuating fluid to an accumulator, the accumulator serving the fuel injectors of an internal combustion engine, and includes a controller being in communication with a plurality of engine related sensors. A variable output pump is in fluid communication with a source of actuating fluid and has at least two selectable output conditions, the pump being operably coupled to the controller, the controller acting to selectively port a portion of the actuating fluid to the accumulator in a first pump output condition and to vent the portion of the actuating fluid to a reservoir in a second pump output condition. The present invention is further a fuel injection system and a method of control.

DETAILED DESCRIPTION OF THE DRAWINGS

Figure 1:
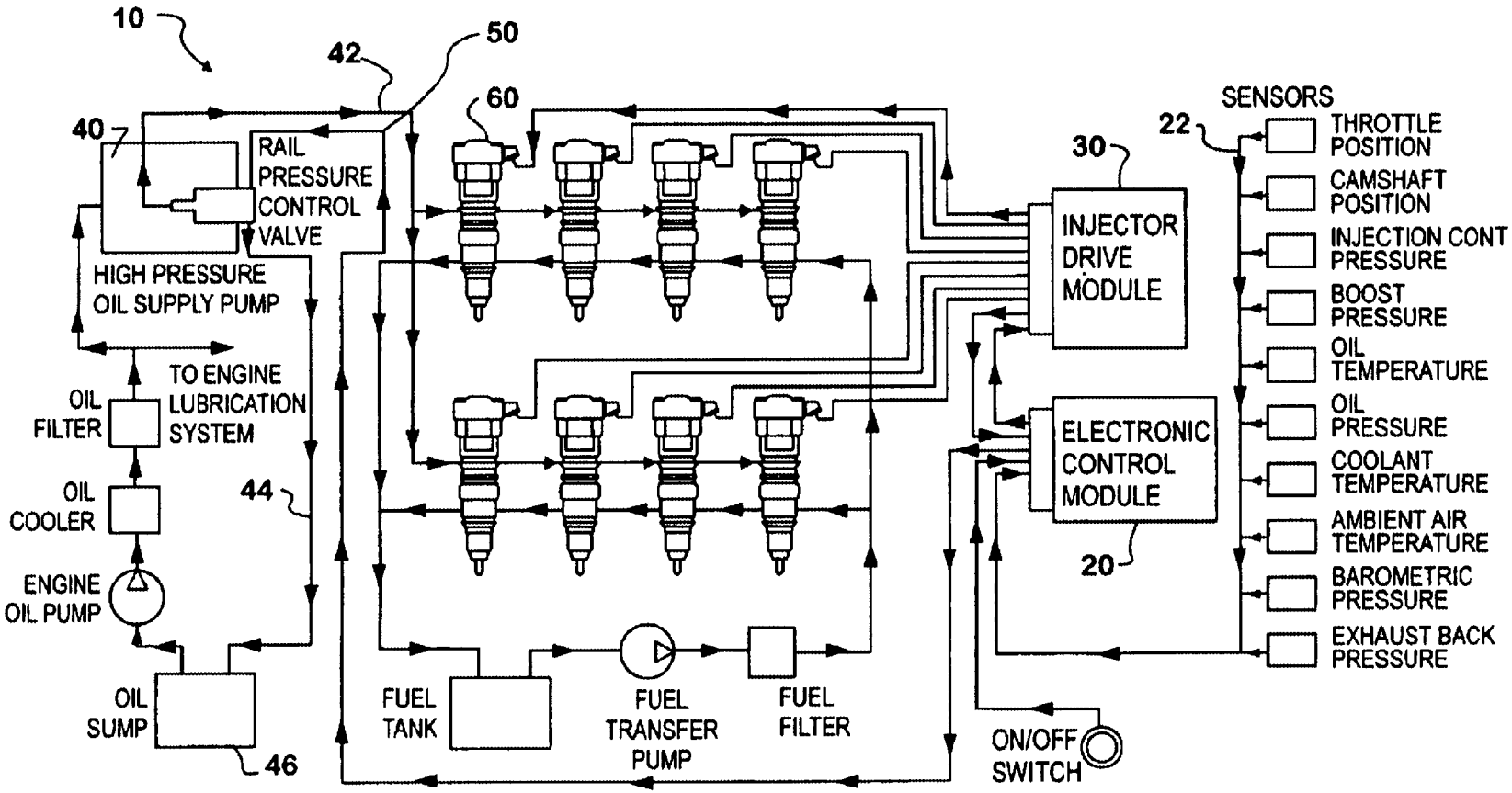
FIG. 1 PRIOR ART
FIG. 1 is schematic representation of a prior art fuel injection system.
Figure 2:
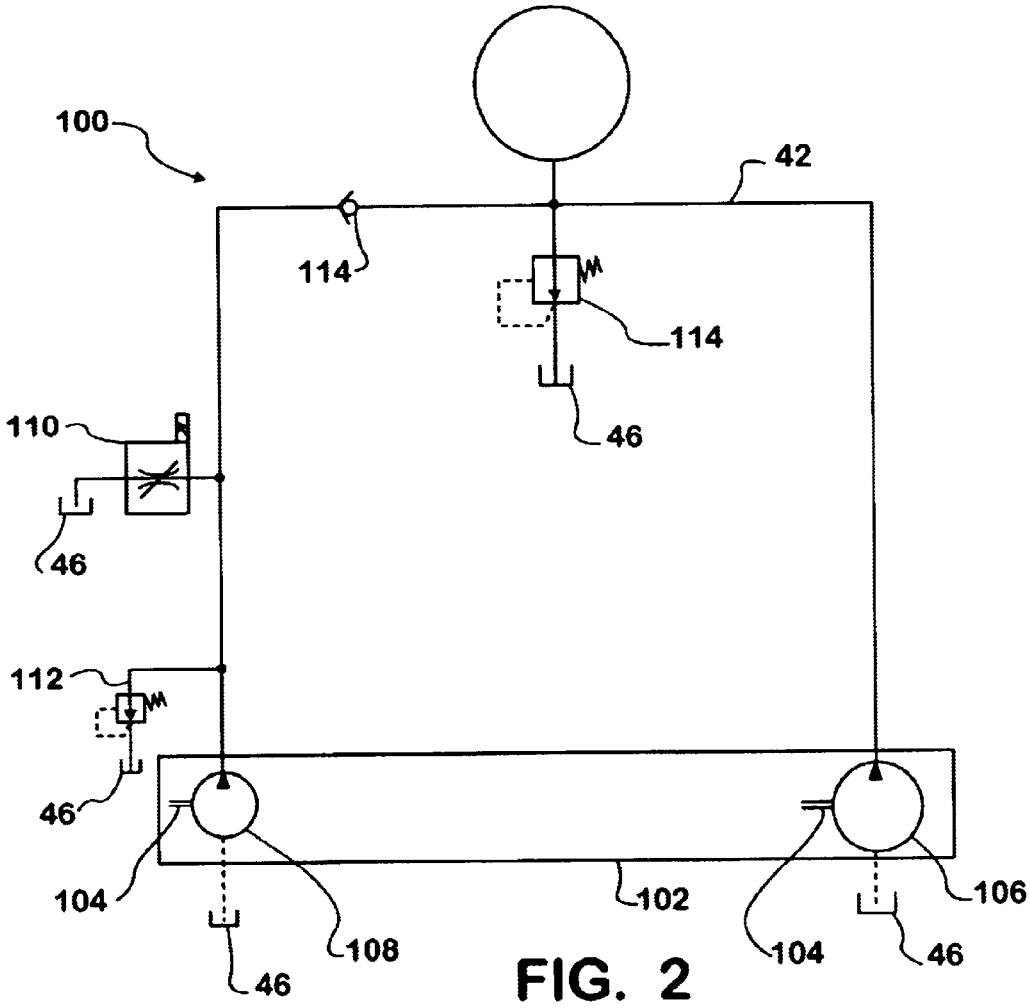
FIG. 2 is schematic representation of the actuating fluid control system of the present invention.
Figure 3:
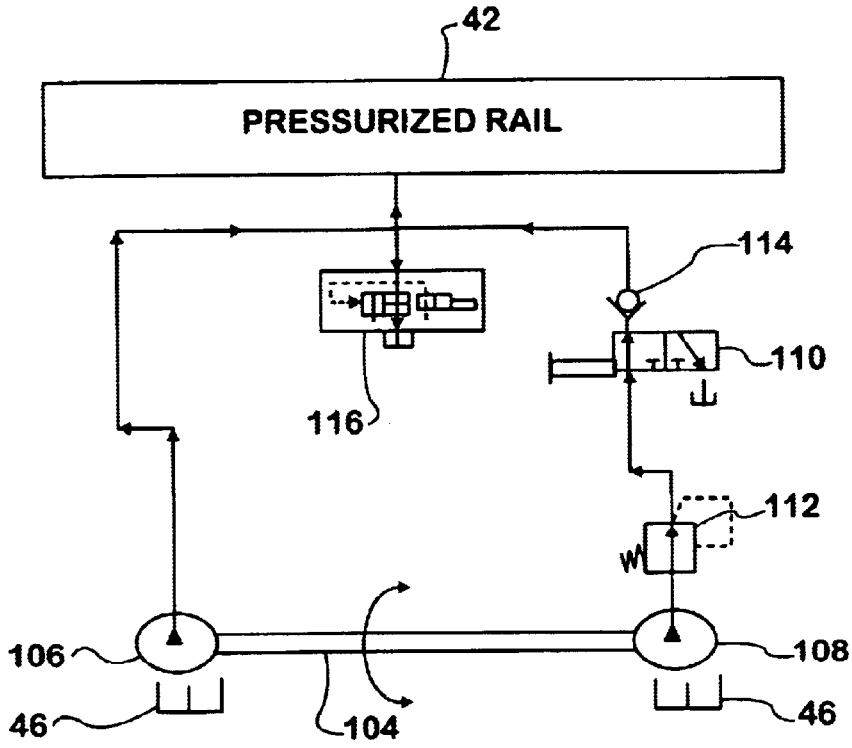
FIG. 3 is schematic representation of the actuating fluid control system of the present invention.

The actuating fluid control system of the present invention is shown generally at 100 as depicted in FIGS. 2 and 3. Referring to FIG. 2, actuating fluid flows from reservoir 46 to variable output pump 102 where power is added via shaft 104 to pressurize the actuating fluid. Shaft 104 is operably coupled to the engine and rotatably driven thereby with a relationship to engine rpm. In a preferred embodiment, the variable output pump 102 has a relatively large stage pump 106 and a relatively small stage pump 108. A common shaft 104 may serve both stages 106, 108, as depicted in FIG. 3. Pressurized fluid flow from the large stage pump 106 flows into the accumulator 42 under all engine operating conditions. This supplies a constant source of actuating fluid to the rail 42 from a relatively larger pumping source to minimize the pressure fluctuations in the rail 42 and stabilize the conditions in the rail 42. Such stability acts to enhance the performance of the respective injectors 60.

Pressurized fluid flow from the small stage pump 108 selectively flows into the accumulator 42 or to the ambient reservoir 46 through a two-position-three-way flow control valve 110 according to the predefined control strategy, as is discussed in greater detail below. A pressure relief valve 112 is used to dampen out any pressure spikes resulting from water hammer effect due to shut off of the flow control valve 110 when a venting of actuating fluid pressure is complete. The pressure relief valve 112 also dumps actuating fluid to the ambient reservoir 46. A check valve 114 is incorporated to prevent backflow from accumulator 42 to pump 108 or to ambient through the control valve 110. An injection pressure-regulating (IPR) valve 116 is used to control the desired pressure in the accumulator 42.

In order to control the flow of actuating fluid from the small pump stage 108, a control strategy has to be defined. As noted above, the large stage pump 106 is not controlled, the output of the large stage pump 106 being always available to the rail 42. From FIGS. 2 and 3, a two-position three-way valve 110 is used under control of the ECM 20. The valve 110 is driven by a proportional solenoid, fed by a voltage source, against a pre-loaded spring. When the solenoid is energized, the control valve 110 is on allowing flow to the accumulator 42. This minimizes the electric power utilized by the actuating fluid control system 100, requiring such power only when the output of the small stage pump 108 is being made available to the rail 42. When de-energized, the control valve 110 is off allowing actuating fluid flow to be dumped to ambient. The small stage pump 108 is pumping actuating fluid when actuating fluid is being dumped to ambient, but it is essentially frictionless pumping since the actuating fluid is being pumped directly to the ambient reservoir 46 and offers no resistance to the pumping action of the small stage pump 108. The power required to effect such pumping is negligible. The position (on/off) of the flow control valve 110 is decided by the ECM 20 as determined by a stored engine load and speed map. A simple hardware change only is implemented in the prior art Engine Control Unit 20 to control the solenoid operation of the control valve 110 of the present invention.

In a preferred embodiment of the actuating fluid control system 100 of the present invention, as applied to a certain V8 configured diesel engine, the actuating fluid required is about 7.2 cc per engine revolution. Of this amount the large pump stage 106 supplies about 4.6 cc per engine revolution or about two-thirds of the actuating fluid required. The small stage pump 108 is capable of making up the remainder. The effect of shifting the small stage pump 108 from supplying actuating fluid to the rail 42 and of dumping the actuating fluid to ambient depending on the conditions in the rail 42 is much less disruptive of rail conditions than in the prior art when the output of the single pump 40 was effectively switched on and off. The fluctuations in the rail 42 caused by shifting the small stage pump 108 on and off are nominal only. The positive effects of actuating fluid control system 100 are both reduction in engine power required and improved stability of injection, a function of stability in the rail 42.

Figure 4:
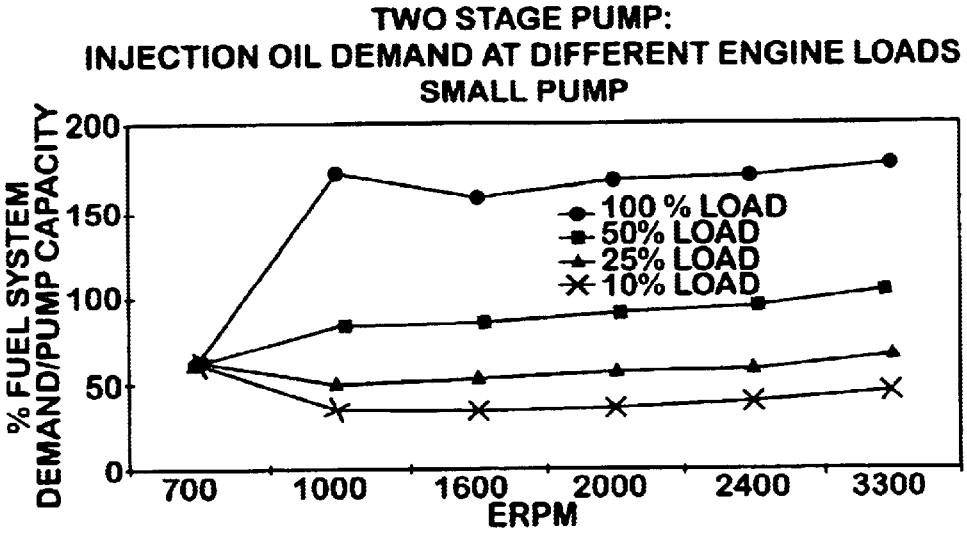
FIG. 4 is a graphic representation of fuel system actuating fluid demand as a percentage of pump capacity for the smaller pump at various engine speed and load conditions.
Figure 5:
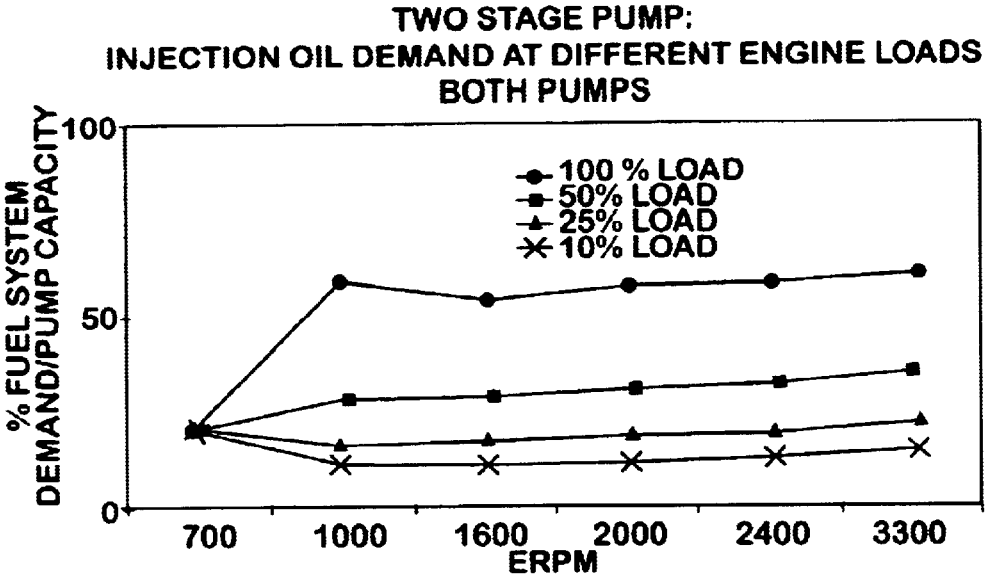
FIG. 5 is a graphic representation of fuel system actuating fluid demand as a percentage of pump capacity for both pumps at various engine speed and load conditions.
Figure 6:
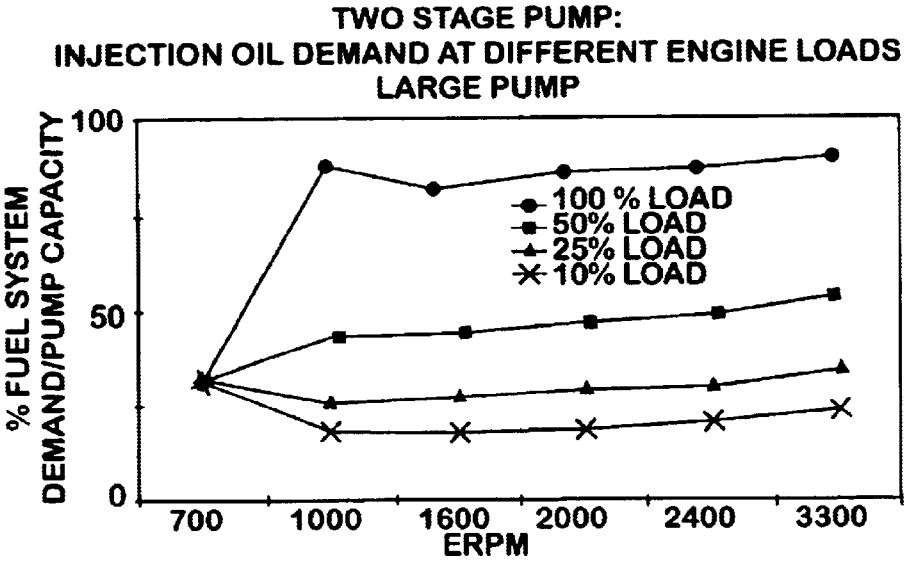
FIG. 6 is a graphic representation of fuel system actuating fluid demand as a percentage of pump capacity for the larger pump at various engine speed and load conditions.

Referring to FIG. 4, it is apparent that the capacity of the small pump would be exceeded by the fuel system demand at all engine speeds greater than 700 rpm, if the engine load is greater than 50 percent. In FIG. 6, the capacity of the large stage pump would never be exceeded, even at 100% load, although it would approach its capacity limit. However, as shown in FIG. 5, in accordance with the invention, with the contribution of actuating fluid from the small stage pump 108 augmenting the output of the large stage pump 106, even at 100% load, there is a generous amount of unused capacity of the combined pumps, thereby permitting the fuel system demand to be accommodated while maintaining a steady continuous supply of actuating fluid to the rail to insure stability of the system and reduce objectionable high pressure fluctuations in the rail.

Figure 7:
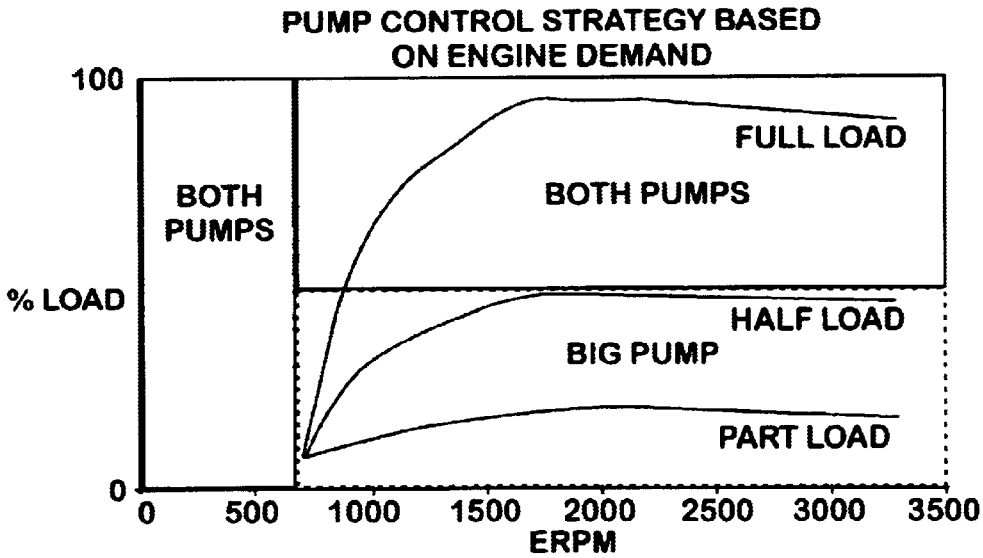
FIG. 7 is a graphic representation of actuating fluid pump control strategy at various engine speed and load conditions.

FIG. 7 illustrates the control strategy for the pump system. During cranking of the engine, a high volume of actuating fluid is required. Accordingly, the output of both pump stages 106, 108 is made available to the rail 42. The cranking stage (during engine start) is generally less than 700 engine rpm. From about 700 rpm to about 3300 engine rpm, only the output of the large stage pump 106 is made available to the rail, when the engine load is less than about 50 percent., and the output of both the small stage pump 108 and the large stage pump 106 is made available to the rail 42 when the engine load is greater than about 50 percent. This map is stored in the ECM 20.

What is claimed is:

1. A control system for controlling the flow of an actuating fluid to an accumulator, the accumulator serving the fuel injectors of an internal combustion engine, comprising:

a controller being in communication with a plurality of engine related sensors;

a multi-stage pump being in fluid communication with a source of actuating fluid;

a valve being in selective fluid communication with the accumulator, with a low pressure reservoir, and with at least one stage of the multi-stage pump, the valve further being in communication with the controller, the controller acting to shift the valve to selectively port actuating fluid to the accumulator and to vent actuating fluid to the reservoir, the valve being a proportional flow control valve in fluid communication with the multi-stage pump and with the low pressure reservoir for smoothly controlling pressure during transition between porting actuating fluid to the accumulator and venting actuating fluid to the reservoir.

2. The control system of claim 1, the multi-stage pump having a first stage and a second stage.

3. The control system of claim 2, the multi-stage pump first stage porting actuating fluid to the accumulator under all engine operating conditions.

4. The control system of claim 2, the multi-stage pump second stage being driven under all engine operating conditions.

5. The control system of claim 4, the multi-stage pump second stage being driven substantially frictionlessly when the valve is venting actuating fluid to the reservoir.

6. The control system of claim 1, the controller acting to shift the valve to selectively port actuating fluid to the accumulator and to vent actuating fluid to the reservoir as a function of a stored engine map.

7. The control system of claim 1, the controller acting to shift the valve to port actuating fluid to the accumulator during periods of high actuating fluid demand.

8. The control system of claim 1, the controller acting to shift the valve to port actuating fluid to the accumulator during engine cranking.

9. The control system of claim 1, the controller acting to shift the valve to port actuating fluid to the accumulator between 700 and 3300 engine RPM when the engine load is greater than substantially fifty percent.

10. The control system of claim 1, the controller acting to shift the valve to vent actuating fluid to the reservoir between 700 and 3300 engine RPM when the engine load is less than substantially fifty percent.

11. The control system of claim 1, the controller acting to shift the valve to selectively port actuating fluid to the accumulator and to vent actuating fluid to the reservoir in order to constantly supply the accumulator with actuating fluid throughout all engine speeds and load conditions while minimizing the power consumed by the multi-stage pump.

12. A control system for controlling the flow of an actuating fluid to an accumulator, the accumulator serving the fuel injectors of an internal combustion engine, comprising:

a controller being in communication with a plurality of engine related sensors;

a variable output pump being in fluid communication with a source of actuating fluid and having at least two selectable output conditions, the pump being operably coupled to the controller, the controller acting to selectively port a portion of the actuating fluid to the accumulator in a first pump output condition and to vent the portion of the actuating fluid to a reservoir in a second pump output condition, the valve being proportional flow control valve in fluid communication with the multi-stage pump and with the low pressure reservoir for smoothly controlling pressure during transition between porting actuating fluid to the accumulator and venting actuating fluid to the reservoir.

13. The control system of claim 12, the variable output pump having a first stage and a second stage.

14. The control system of claim 13, the variable output pump first stage porting actuating fluid to the accumulator under all engine operating conditions.

15. The control system of claim 13, the variable output pump second stage being driven under all engine operating conditions.

16. The control system of claim 15, the variable output pump second stage being driven substantially frictionlessly when the valve is venting actuating fluid to the reservoir.

17. The control system of claim 12, the controller acting to selectively port actuating fluid to the accumulator and to vent actuating fluid to the reservoir as a function of a stored engine map.

18. The control system of claim 12, the controller acting to port actuating fluid to the accumulator during periods of high actuating fluid demand.

19. The control system of claim 12, the controller acting to port actuating fluid to the accumulator during engine cranking.

20. The control system of claim 12, the controller acting to port actuating fluid to the accumulator between 700 and 3300 engine RPM when the engine load is greater than substantially fifty percent.

21. The control system of claim 12, the controller acting to vent actuating fluid to the reservoir between 700 and 3300 engine RPM when the engine load is less than substantially fifty percent.

22. The control system of claim 12, the controller acting to selectively port actuating fluid to the accumulator and to vent actuating fluid to the reservoir in order to constantly supply the accumulator with actuating fluid throughout all engine speeds and load conditions while minimizing the power consumed by the variable output pump.

23. A fuel injection system of an internal combustion engine having a plurality of fuel injectors, an actuating fluid under pressure in an accumulator, the accumulator serving the fuel injectors with actuating fluid for intensification of fuel to be injected, comprising:

a controller being in communication with a plurality of engine related sensors;

a variable output pump being in fluid communication with a source of actuating fluid and having at least two selectable output conditions, the pump being operably coupled to the controller, the controller acting to selectively port a portion of the actuating fluid to the accumulator in a first pump output condition and to vent the portion of the actuating fluid to a reservoir in a second pump output condition; and a proportional flow control valve in fluid communication with the variable output pump and with the low pressure reservoir for smoothly controlling pressure during transition between porting actuating fluid to the accumulator and venting actuating fluid to the reservoir.

24. The fuel injection system of claim 23, the variable output pump having a first stage and a second stage.

25. The fuel injection system of claim 24, the variable output pump first stage porting actuating fluid to the accumulator under all engine operating conditions.

26. The fuel injection system of claim 24, the variable output pump second stage being driven under all engine operating conditions.

27. The fuel injection system of claim 26, the variable output pump second stage being driven substantially frictionlessly when the valve is venting actuating fluid to the reservoir.

28. The fuel injection system of claim 23, the controller acting to selectively port actuating fluid to the accumulator and to vent actuating fluid to the reservoir as a function of a stored engine map.

29. The fuel injection system of claim 23, the controller acting to port actuating fluid to the accumulator during periods of high actuating fluid demand.

30. The fuel injection system of claim 23, the controller acting to port actuating fluid to the accumulator during engine cranking.

31. The fuel injection system of claim 23, the controller acting to port actuating fluid to the accumulator between 700 and 3300 engine RPM when the engine load is greater than substantially fifty percent.

32. The fuel injection system of claim 23, the controller acting to vent actuating fluid to the reservoir between 700 and 3300 engine RPM when the engine load is less than substantially fifty percent.

33. The fuel injection system of claim 23, the controller acting to selectively port actuating fluid to the accumulator and to vent actuating fluid to the reservoir in order to constantly supply the accumulator with actuating fluid throughout all engine speeds and load conditions while minimizing the power consumed by the variable output pump.

34. A control method for controlling the flow of an actuating fluid to an accumulator, the accumulator serving the fuel injectors of an internal combustion engine, comprising:

sensing a plurality of engine related parameters;

pumping actuating fluid from a source of actuating fluid;

selectively porting a portion of the actuating fluid to the accumulator in a first output condition and venting the portion of the actuating fluid to a reservoir in a second output condition; and smoothly controlling pressure during transition between porting actuating fluid to the accumulator and venting actuating fluid to the reservoir by means of a proportional flow control valve.

35. The control method of claim 34, porting actuating fluid to the accumulator from a pump first stage under all engine operating conditions.

36. The control method of claim 34, driving a pump second stage under all engine operating conditions.

37. The control method of claim 36, driving the pump second stage substantially frictionlessly when the valve is venting actuating fluid.

38. The control method of claim 34, selectively porting a portion of the actuating fluid to the accumulator and venting the portion of the actuating fluid to a reservoir as a function of a stored engine map.

39. The control method of claim 34, porting a relatively greater portion of the actuating fluid to the accumulator during periods of high actuating fluid demand.

40. The control method of claim 34, porting a relatively greater portion of the actuating fluid to the accumulator during engine cranking.

41. The control method of claim 34, the controller acting to port a relatively greater portion of the actuating fluid to the accumulator between 700 and 3300 engine RPM when the engine load is greater than substantially fifty percent.

42. The control method of claim 34, the controller acting to vent a portion of the actuating fluid to a reservoir between 700 and 3300 engine RPM when the engine load is less than substantially fifty percent.

43. The control method of claim 34, selectively porting actuating fluid to the accumulator and selectively venting actuating fluid to a reservoir in order to constantly supply the accumulator with actuating fluid throughout all engine speeds and load conditions while minimizing the power consumed by the variable output pump.

* * * * *